US010293911B2

(12) United States Patent
Saruwatari et al.

(10) Patent No.: US 10,293,911 B2
(45) Date of Patent: May 21, 2019

(54) OUTBOARD MOTOR

(71) Applicant: YAMAHA HATSUDOKI KABUSHIKI KAISHA, Iwata-shi, Shizuoka (JP)

(72) Inventors: Kimitaka Saruwatari, Shizuoka (JP); Chiharu Masuda, Shizuoka (JP); Satoshi Miyazaki, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 16/052,666

(22) Filed: Aug. 2, 2018

(65) Prior Publication Data

US 2019/0112018 A1 Apr. 18, 2019

(30) Foreign Application Priority Data

Oct. 13, 2017 (JP) ..... 2017-199858

(51) Int. Cl.

| | |
|---|---|
| ***B63H 20/28*** | (2006.01) |
| ***F01P 3/20*** | (2006.01) |
| ***F01P 5/12*** | (2006.01) |
| ***F01P 7/16*** | (2006.01) |
| ***F01M 5/00*** | (2006.01) |

(52) U.S. Cl.

CPC ..... *B63H 20/28* (2013.01); *F01M 5/002* (2013.01); *F01P 3/202* (2013.01); *F01P 5/12* (2013.01); *F01P 7/16* (2013.01); *F01M 2005/004* (2013.01); *F01P 2025/50* (2013.01); *F01P 2050/12* (2013.01); *F01P 2060/04* (2013.01)

(58) Field of Classification Search

CPC ..... B63H 20/28; F01M 5/002; F01P 3/202

See application file for complete search history.

(56) References Cited

U.S. PATENT DOCUMENTS

| | | | | |
|---|---|---|---|---|
| 5,921,829 | A * | 7/1999 | Iwata | F01P 3/202 440/88 J |
| 6,418,887 | B1 * | 7/2002 | Okamoto | F01M 5/005 123/41.33 |
| 6,821,171 | B1 * | 11/2004 | Wynveen | B63H 21/38 123/41.08 |
| 7,128,025 | B1 * | 10/2006 | Westhoff, Jr. | F01P 3/202 123/41.01 |

(Continued)

FOREIGN PATENT DOCUMENTS

JP 2000-120420 A 4/2000

*Primary Examiner* — S. Joseph Morano
*Assistant Examiner* — Jovon E Hayes
(74) *Attorney, Agent, or Firm* — Keating and Bennett, LLP

(57) ABSTRACT

An outboard motor includes an engine, a cooling water passage, a pump that is driven in conjunction with the engine, an inlet water passage that branches from the cooling water passage, an oil cooler, an outlet water passage, a first thermostat located in the cooling water passage, and a second thermostat. The pump takes outside water into the cooling water passage. The oil cooler includes a water-storing space into which water in the inlet water passage is taken. The outlet water passage is connected to an outlet of the oil cooler. The first thermostat increases and decreases the flow rate of water flowing through the engine. The second thermostat is located at the outlet or at the outlet water passage, and increases and decreases the flow rate of water flowing through the outlet water passage.

6 Claims, 6 Drawing Sheets

(56) References Cited

U.S. PATENT DOCUMENTS

| | | | | |
|---|---|---|---|---|
| 7,264,520 | B1 * | 9/2007 | Taylor | F01P 11/08<br>440/88 HE |
| 7,370,611 | B1 * | 5/2008 | White | F01P 3/12<br>123/196 AB |
| 7,398,745 | B1 * | 7/2008 | White | F01P 5/14<br>123/41.01 |
| 7,806,740 | B1 * | 10/2010 | Taylor | F01M 5/00<br>123/41.1 |
| 9,227,714 | B2 * | 1/2016 | Saruwatari | B63H 20/28 |
| 2015/0133007 | A1 * | 5/2015 | Saruwatari | B63H 20/28<br>440/88 L |
| 2017/0328265 | A1 * | 11/2017 | George | F01P 3/202 |

* cited by examiner

OUTBOARD MOTOR

CROSS REFERENCE TO RELATED APPLICATIONS

This application claims the benefit of priority to Japanese Patent Application No. 2017-199858 filed on Oct. 13, 2017. The entire contents of this application are hereby incorporated herein by reference.

BACKGROUND OF THE INVENTION

1. Field of the Invention

The present invention relates to an outboard motor that includes an oil cooler by which lubrication oil of an engine is cooled.

2. Description of the Related Art

An outboard motor disclosed by Japanese Patent Application Publication No. 2000-120420 includes an engine, an oil pan, a drive shaft, an oil pump, an oil-supply oil passage, an oil cooler, an engine-cooling piping, an oil-cooler-cooling piping, and a cooling-water pump. The engine includes a piston, a crankshaft, a cylinder block, and a cylinder head. The cylinder block is provided with a cylinder that contains the piston, a crank chamber that contains the crankshaft, a combustion chamber, and a cylinder-cooling water passage. The cylinder head closes the combustion chamber. A head-cooling water passage is formed at the cylinder head. Lubrication oil of the engine is stored in the oil pan. The drive shaft is connected to the crankshaft, and is rotated by the engine. The oil pump operates in conjunction with the rotation of the drive shaft. The oil-supply oil passage connects a discharge port of the oil pump and the crank chamber to each other. The oil cooler is located at the oil-supply oil passage. The engine-cooling piping is connected to the cylinder-cooling water passage and to the head-cooling water passage. The oil-cooler-cooling piping is connected to the oil cooler. The cooling-water pump operates in conjunction with the rotation of the drive shaft.

When the oil pump operates, the lubrication oil in the oil pan is circulated by being supplied to the crank chamber via the oil-supply oil passage and then collected in the oil pan. The lubrication oil flowing through the oil-supply oil passage is cooled by the cooling water of the oil cooler. When the cooling-water pump operates, water, such as sea water or lake water, i.e., cooling water outside the outboard motor is drawn in, and flows through the engine-cooling piping and through the oil-cooler-cooling piping. Water flowing through the engine-cooling piping flows through the cylinder-cooling water passage or through the head-cooling water passage, and cools the cylinder block or the cylinder head, and is then discharged outwardly from the outboard motor via a thermostat. When the temperature of the cooling water is below a predetermined temperature, the thermostat closes the flow passage so that the cooling water does not flow through the engine-cooling piping. This makes it possible to accelerate a prompt warm-up, and to prevent the cylinder block and the cylinder head from being excessively cooled. The cooling water that has flowed from the oil-cooler-cooling piping into the oil cooler cools the lubrication oil as described above, and is then discharged outwardly from the outboard motor via a drainpipe.

Preferably, the temperature of lubrication oil of the engine (hereinafter, referred to as "oil temperature" when necessary) is kept at an optimum temperature within a predetermined range regardless of a surrounding environment or the number of revolutions of the engine. If the oil temperature exceeds the optimum temperature, there is a concern that a defect in lubrication will occur between sliding components because of oil film breakage in the engine or a concern that an increase in engine temperature will cause a reduction in the lifetime of auxiliary machinery such as electric components, or will cause a deterioration of resinous components or the lubrication oil. On the other hand, if the oil temperature falls below the optimum temperature, for example, in winter, there is a concern that the lubrication oil will become cloudy because of dew condensation water generated in the crank chamber mixes with the lubrication oil, and, as a result, a defect in lubrication will occur between sliding components. Additionally, there is the possibility in which fuel supplied to the combustion chamber of the engine enters the crank chamber through a gap between the piston and the cylinder. If the oil temperature is an optimum temperature, fuel that has entered the crank chamber is vaporized, and returns to the combustion chamber through a blowby passage. However, if the oil temperature falls below the optimum temperature, fuel that has entered the crank chamber cannot be vaporized, and stays in the crank chamber, and mixes with the lubrication oil, and therefore there is a concern that the dilution of the lubrication oil will occur, and, as a result, a defect in lubrication will occur between sliding components. Additionally, there is a concern that the warm-up operation of the engine will be prolonged, and fuel consumption will increase if the oil temperature falls below the optimum temperature. Additionally, there is a concern that an increase in viscosity of the lubrication oil will increase the friction between sliding components, and will reduce fuel economy.

The outboard motor of Japanese Patent Application Publication No. 2000-120420 is configured to use outside water, such as sea water, as cooling water and to send this cooling water to the oil-cooler-cooling piping by the cooling-water pump that operates with the engine. Therefore, the lubrication-oil cooling capability of the oil cooler is susceptible to the surrounding environment, such as the temperature of outside water, or is susceptible to the number of engine revolutions. More specifically, if the outside water has a low temperature, the lubrication oil of the oil cooler is forcibly cooled by the low-temperature cooling water flowing through the oil-cooler-cooling piping even if the oil temperature is intended to be increased. Additionally, the amount of cooling water flowing through the oil-cooler-cooling piping is increased by the thermostat limiting the amount of cooling water flowing through the engine-cooling piping as described above, and therefore the lubrication oil is further cooled. Additionally, the cooling-water pump that operates with the engine forcibly sends cooling water to the oil-cooler-cooling piping even if it is desired to increase the oil temperature in a state in which the number of engine revolutions is low when the engine is started, etc., and therefore the lubrication oil is cooled. If the amount of cooling water supplied to the oil-cooler-cooling piping is reduced in order to avoid cooling the lubrication oil, there is a concern that the oil temperature during high revolutions of the engine will exceed the optimum temperature.

SUMMARY OF THE INVENTION

In view of the previously unrecognized and unsolved challenges described above, preferred embodiments of the present invention provide outboard motors that include an engine, a cooling water passage, a pump, an inlet water passage, an oil cooler, an outlet water passage, a first thermostat, and a second thermostat. The cooling water passage allows water to flow from an inflow port located in the water to an outflow port via the engine. The pump takes outside water from the inflow port into the cooling water passage by being driven in conjunction with the engine. The inlet water passage branches from the cooling water passage. The oil cooler includes an inlet connected to the inlet water passage, a water-storing space into which water in the inlet water passage is taken from the inlet, and an outlet from which water in the water-storing space is discharged, and the oil cooler cools lubrication oil of the engine. The outlet water passage is connected to the outlet. The first thermostat is located in the cooling water passage, and increases and decreases the flow rate of water flowing through the engine. The second thermostat is located at the outlet or at the outlet water passage, and increases and decreases the flow rate of water flowing through the outlet water passage.

In accordance with a preferred embodiment of the present invention, the pump driven in conjunction with the engine takes outside water into the cooling water passage from the inflow port located in the outside water. Outside water that has been taken into the cooling water passage flows through the engine and cools the engine as cooling water, and then flows out from the outflow port. The first thermostat located in the cooling water passage increases and decreases the flow rate of cooling water flowing through the engine in the cooling water passage. Consequently, the first thermostat prevents the engine from being overheated by increasing the flow rate of cooling water flowing through the engine, and prevents the engine from being excessively cooled by decreasing the flow rate thereof.

The inlet water passage that branches from the cooling water passage is connected to the inlet of the oil cooler. Cooling water that has flowed into the inlet water passage from the cooling water passage is taken from the inlet into the water-storing space of the oil cooler, and cools the lubrication oil of the engine in the water-storing space, and then flows out from the outlet of the oil cooler to the outlet water passage. The second thermostat located at the outlet or the outlet water passage increases and decreases the flow rate of water flowing through the outlet water passage. More specifically, when water taken into the cooling water passage has a low temperature or when the number of revolutions of the engine is low because of, for example, start-up time, i.e., when the lubrication oil has a low temperature, the second thermostat decreases its opening degree in accordance with the temperature of the low-temperature cooling water flowing out from the water-storing space. Consequently, the second thermostat decreases the flow rate of cooling water flowing through the outlet water passage. Therefore, the amount of cooling water taken into the water-storing space decreases, and therefore it is possible to prevent a decrease in the oil temperature. In this state, the lubrication oil is warmed by the engine, and therefore it is possible to swiftly increase the oil temperature to an optimum temperature. On the other hand, when the engine rotates at a high speed, i.e., when the lubrication oil has a high temperature, the second thermostat increases its opening degree in accordance with the temperature of cooling water that has become high in temperature due to heat exchange with the lubrication oil. Consequently, the second thermostat increases the flow rate of cooling water flowing through the outlet water passage. Therefore, the lubrication oil is effectively cooled by a large amount of cooling water newly taken into the water-storing space, and therefore it is possible to prevent the oil temperature from exceeding the optimum temperature. As a result, it is possible to keep the oil temperature at the optimum temperature regardless of the surrounding environment or the number of revolutions of the engine.

According to a preferred embodiment of the present invention, the outlet water passage is joined to the cooling water passage. In accordance with this preferred embodiment, cooling water that has flowed out from the outlet of the oil cooler to the outlet water passage is returned to the cooling water passage, and is discharged outwardly from the outflow port. Therefore, another outflow port that differs from the outflow port is not required to be provided as a discharge port in order to outwardly discharge cooling water flowing through the outlet water passage. It is possible to keep the oil temperature at an optimum temperature with this simple structure.

According to a preferred embodiment of the present invention, the engine includes an engine block in which the lubrication oil is contained, and the oil cooler is located at a wall that is bathed in the lubrication oil in the engine block. In accordance with this preferred embodiment, lubrication oil in which the wall in the engine block has been bathed is cooled by allowing cooling water taken into the water-storing space of the oil cooler to cool the wall. Therefore, a structure in which lubrication oil in the engine block is taken out, and is cooled by the oil cooler, and is then returned into the engine block is not required. It is possible to keep the oil temperature at an optimum temperature with this simple structure.

According to a preferred embodiment of the present invention, the oil cooler includes the wall and a cover that is attached to the wall and that defines the water-storing space. In accordance with this preferred embodiment, it is possible to define the water-storing space by the cover attached to the wall of the engine block. It is possible to keep the oil temperature at an optimum temperature with this simple structure.

According to a preferred embodiment of the present invention, the outlet is provided in the cover. In accordance with this preferred embodiment, cooling water in the water-storing space is allowed to flow out from the outlet to the outlet water passage by connecting the outlet water passage to the outlet of the cover.

According to a preferred embodiment of the present invention, the outboard motor includes a plurality of oil coolers each corresponding to the oil cooler described above. In accordance with this preferred embodiment, the cooling effect of the lubrication oil is increased by the plurality of oil coolers, and therefore it is possible to prevent the oil temperature from exceeding the optimum temperature. Likewise, with this structure, it is possible to swiftly increase the oil temperature to the optimum temperature while preventing a decrease in the oil temperature by the second thermostat, for example, when water taken into the cooling water passage has a low temperature or when the number of revolutions of the engine is low, and therefore it is possible to keep the oil temperature at the optimum temperature.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
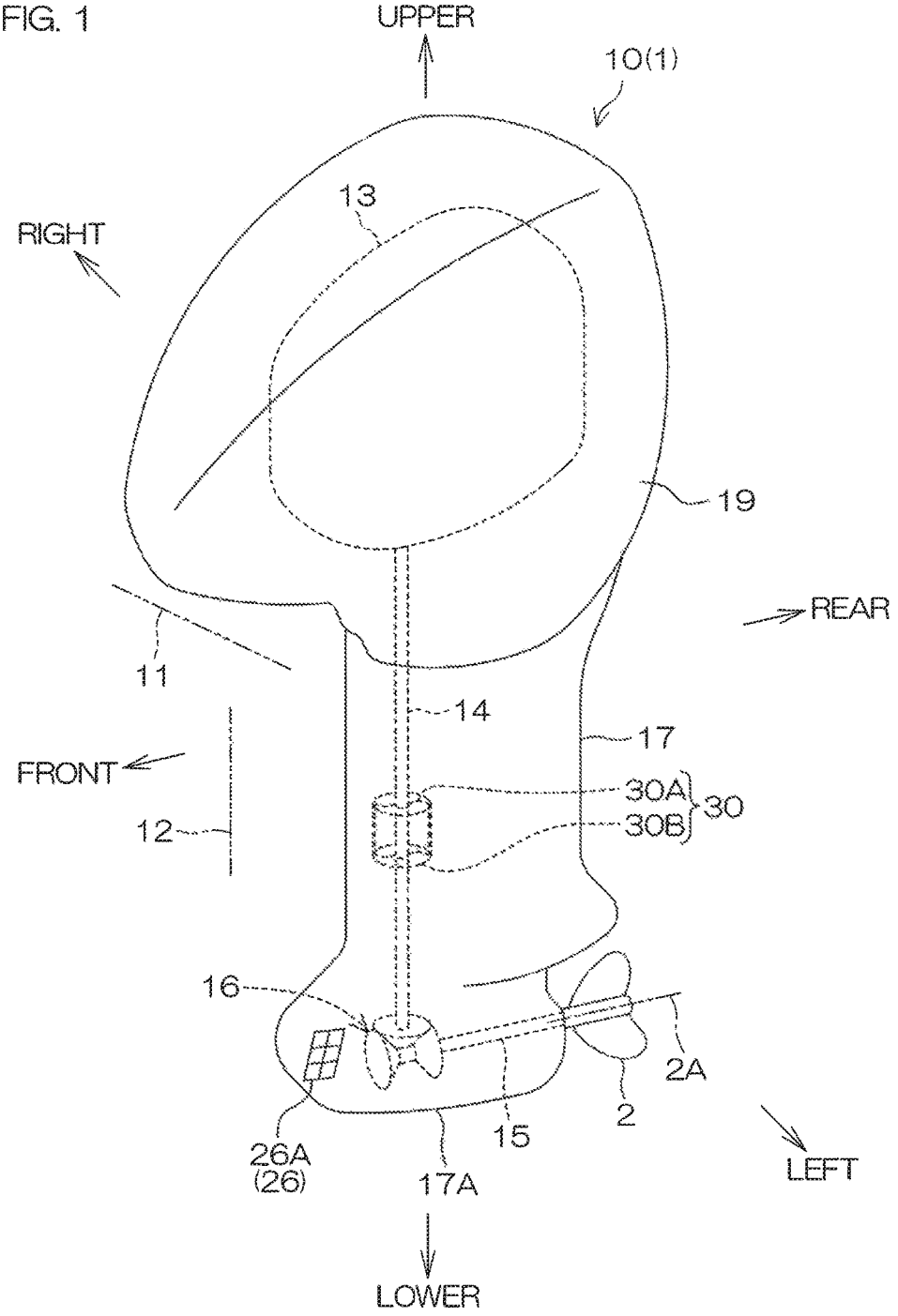
FIG. 1 is a schematic perspective view of an outboard motor according to a preferred embodiment of the present invention.

Preferred embodiments of the present invention will be hereinafter described in detail with reference to the accompanying drawings. FIG. 1 is a schematic front perspective view of an outboard motor 1 according to a preferred embodiment of the present invention. FIG. 1 depicts the outboard motor 1 in a basic attitude. The basic attitude is an attitude of the outboard motor 1 when a rotation axis 2A of a propeller 2 in the outboard motor 1 extends along both the horizontal direction and the front-rear direction. The front-rear direction, the left-right direction, and the up-down direction in the following description correspond to the front-rear direction, the left-right direction, and the up-down direction taken when the outboard motor 1 is in the basic attitude, respectively.

The outboard motor 1 includes an outboard motor body 10 and a mounting mechanism (not shown) to mount the outboard motor body 10 on a hull (not shown). In a state of being supported by the mounting mechanism, the outboard motor body 10 is turnable upwardly and downwardly around an abscissa axis 11 extending in the left-right direction, and is turnable rightwardly and leftwardly around an ordinate axis 12 extending in the up-down direction. The outboard motor body 10 includes the propeller 2, an engine 13, a drive shaft 14, a propeller shaft 15, a gear mechanism 16, a casing 17, an exhaust guide 18 (see FIG. 2 described below), and an engine cover 19.

The engine 13 is preferably an internal combustion engine, and a piston (not shown) and a crankshaft 20 (see FIG. 3 described below) are built into the engine 13. The crankshaft 20 is rotated around a crankshaft axis 20A extending in the up-down direction (see FIG. 3) by the reciprocating rectilinear motion of the piston.

The drive shaft 14 is connected to a lower end of the crankshaft 20, and extends downwardly. The drive shaft 14 rotates together with the crankshaft 20. The propeller shaft 15 extends along the front-rear direction below a lower end of the drive shaft 14. The gear mechanism 16 connects the lower end of the drive shaft 14 and a front end of the propeller shaft 15 to each other. The propeller 2 is attached to a rear end of the propeller shaft 15. The rotation of the drive shaft 14 in response to the driving of the engine 13 is transmitted to the propeller shaft 15 by the gear mechanism 16. Consequently, the propeller 2 is driven and rotated by the engine 13. The rotation axis 2A of the propeller 2 coincides with a central axis of the propeller shaft 15. A thrust by which the hull is moved forwardly or backwardly is generated by the rotation of the propeller 2.

The casing 17 is a hollow body that extends in the up-down direction, and contains the drive shaft 14, the propeller shaft 15, and the gear mechanism 16. The propeller shaft 15 and the gear mechanism 16 are contained in a lower case 17A that is a lower end portion of the casing 17. The propeller 2 is located outside the lower case 17A. When the outboard motor 1 is in the basic attitude, the propeller 2 and the lower case 17A are located in the outside water.

The exhaust guide 18 is preferably plate shaped or substantially plate shaped. The exhaust guide 18 is attached to an upper end portion of the casing 17 so as to close an internal space of the casing 17 from above. The engine 13 is mounted on an upper surface of the exhaust guide 18. The engine cover 19 is preferably box shaped or substantially box shaped, and is positioned above the casing 17, and covers the engine 13.

Figure 2:
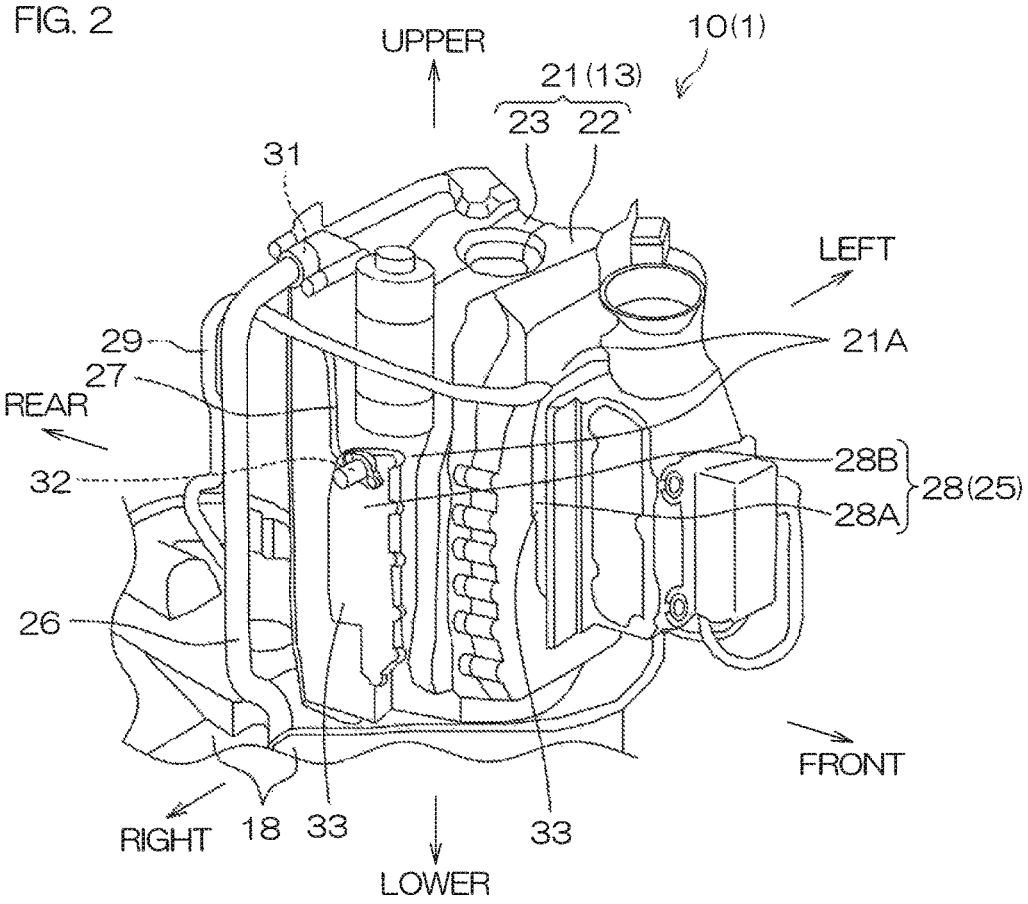
FIG. 2 is a schematic perspective view of a main portion of the outboard motor from which an engine cover has been detached.

FIG. 2 is a schematic perspective view of a main portion of the outboard motor 1 from which the engine cover 19 has been detached. The engine 13 includes an engine block 21. The engine block 21 includes a crankcase 22 that contains the crankshaft 20 and a cylinder 23 that contains the piston. The engine 13 additionally includes a cylinder head (not shown) located behind the engine block 21. A combustion chamber (not shown) surrounded by the piston, the cylinder head, and the cylinder 23, is provided in the cylinder 23. Fuel is jetted into the combustion chamber, and, as a result, an air-fuel mixture is generated, and the piston is linearly reciprocated by the combustion of the air-fuel mixture in the combustion chamber. Lubrication oil, such as engine oil, is contained in the crankcase 22. The range of an optimum temperature of the lubrication oil is, for example, from about 70° C. to about 120° C.

Figure 3:
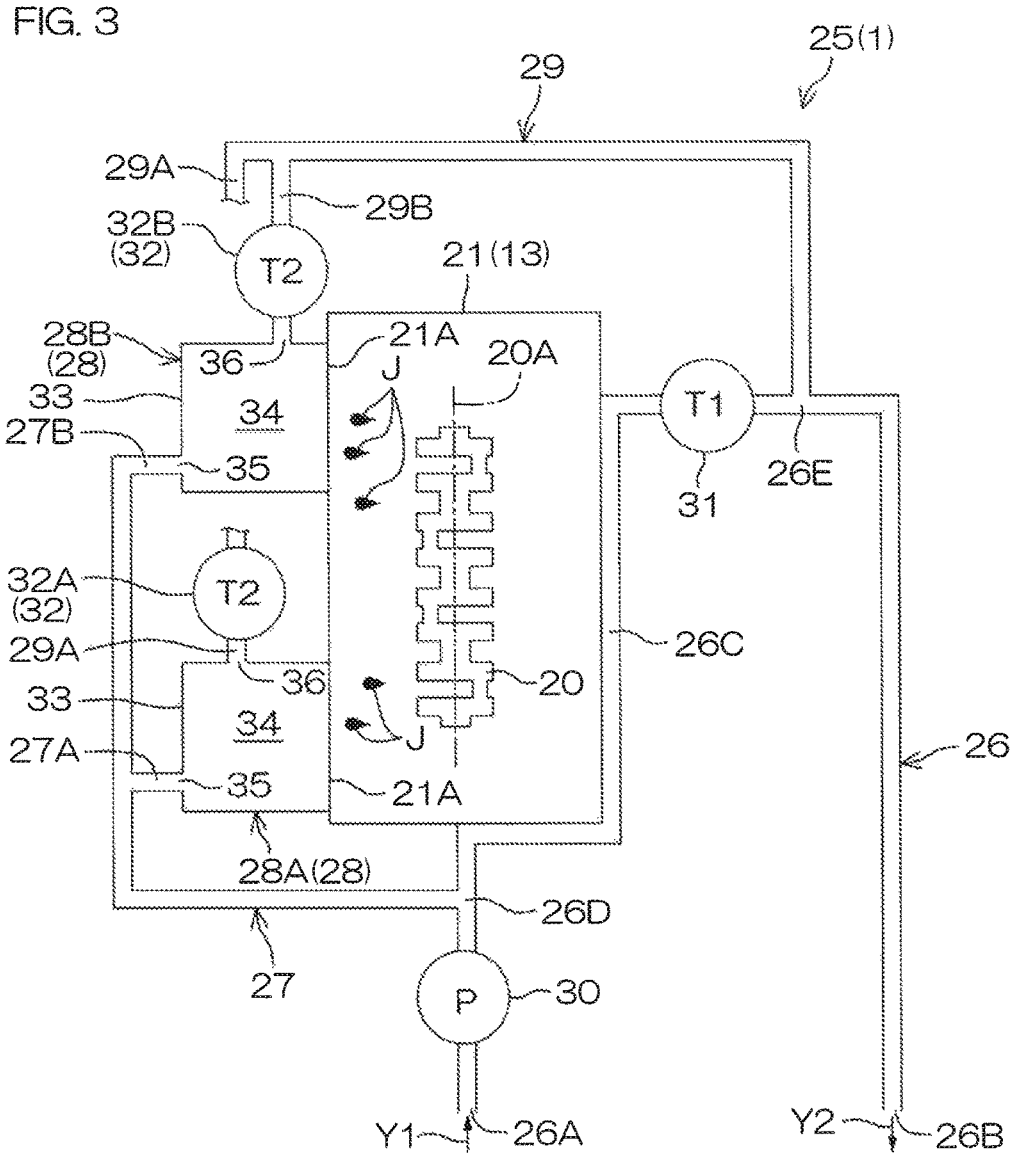
FIG. 3 is a schematic view showing a cooling device in the outboard motor.

The outboard motor 1 includes a cooling device 25 that cools each component of the outboard motor 1 including the engine 13. FIG. 3 is a schematic view showing the cooling device 25. The cooling device 25 includes a cooling water passage 26, an inlet water passage 27, an oil cooler 28, an outlet water passage 29, a pump 30, a first thermostat 31, and a second thermostat 32.

The cooling water passage 26 includes an inflow port 26A and an outflow port 26B, and extends from the inflow port 26A to the outflow port 26B. The inflow port 26A is opened at an outer surface of the lower case 17A of the casing 17 (see FIG. 1). When the outboard motor 1 is in the basic attitude, the inflow port 26A is located in the outside water. A plurality of inflow ports 26A may be provided. The outflow port 26B is opened at an outer surface of the casing 17. The cooling water passage 26 includes a halfway portion 26C passing through the engine block 21. The halfway portion 26C extends along an outer surface of the engine block 21, and passes through a wall of the engine block 21. In the cooling water passage 26, most portions except the inflow port 26A, the outflow port 26B, and the halfway portion 26C are located in the casing 17.

The inlet water passage 27 branches from a portion closer to the inflow port 26A than the halfway portion 26C in the cooling water passage 26.

Figure 4:
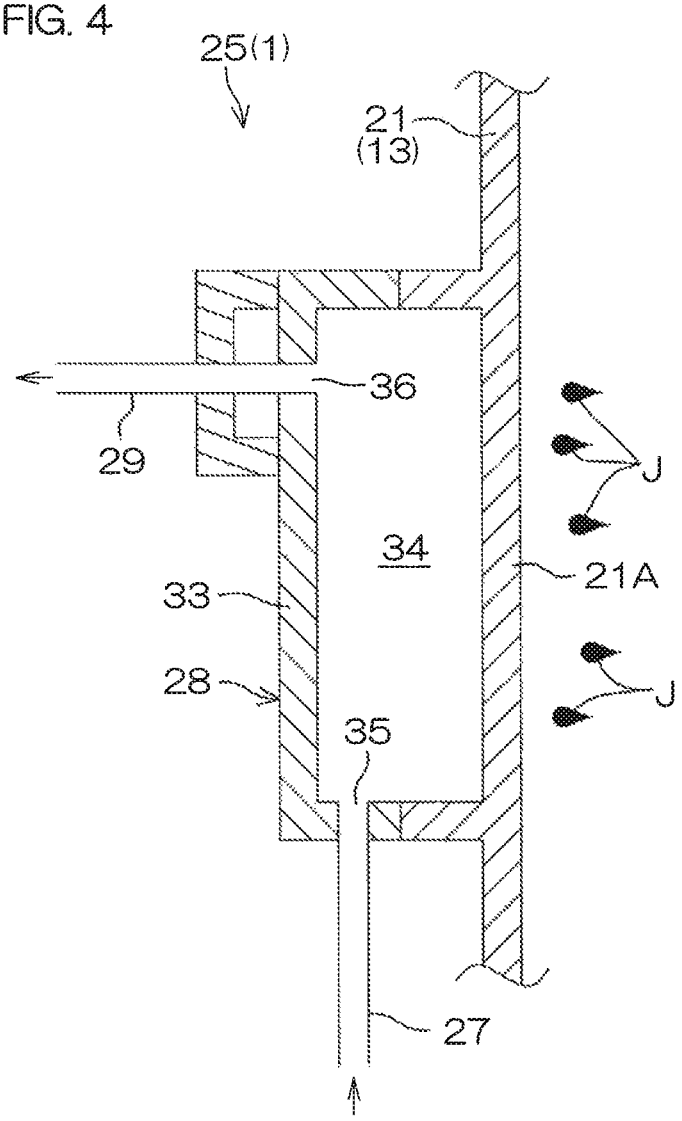
FIG. 4 is a schematic cross-sectional view of an oil cooler of the outboard motor.

A single oil cooler 28 or a plurality of oil coolers 28 may be provided. The outboard motor 1 in the present preferred embodiment includes two oil coolers 28A and 28B, for example. These are referred to generically as the "oil cooler 28" when necessary. Each oil cooler 28 is located at a wall 21A that is bathed in lubrication oil J in the engine block 21. An inner surface of the wall 21A is bathed in the lubrication oil J stirred by the rotating crankshaft 20. For example, the oil cooler 28A is located at a front wall of the crankcase 22, and the oil cooler 28B is located at a right wall of the cylinder 23 (see FIG. 2). The front wall of the crankcase 22 and the right wall of the cylinder 23 are each an example of the wall 21A. The oil cooler 28 includes the wall 21A and a cover 33 (see FIG. 4 described below). The cover 33 is attached to the wall 21A by a fastener member (not shown) such as a bolt or the like. A sealed water-storing space 34 is defined by the wall 21A and the cover 33. The oil cooler 28 includes the water-storing space 34, an inlet 35, and an outlet 36. The inlet 35 and the outlet 36 are provided in the cover 33, and communicate with the water-storing space 34 (see FIG. 4). The inlet 35 is connected to the inlet water passage 27. The inlet water passage 27 branches into two end portions 27A and 27B corresponding to the two oil coolers 28. The end portions 27A and 27B are connected to the inlet 35 of the oil cooler 28A and the inlet 35 of the oil cooler 28B, respectively.

The outlet water passage 29 includes an outlet water passage 29A connected to the outlet 36 of the oil cooler 28A and an outlet water passage 29B connected to the outlet 36 of the oil cooler 28B. The outlet water passage 29A and the outlet water passage 29B join each other, and become a single outlet water passage 29, and this single outlet water passage 29 joins a portion closer to the outflow port 26B than the halfway portion 26C in the cooling water passage 26.

The pump 30 is located at a portion closer to the inflow port 26A than a connection portion 26D joined to the inlet water passage 27 in the cooling water passage 26. The pump 30 includes an impeller 30A that rotates together with the drive shaft 14 and a pump case 30B that contains the impeller 30A (see FIG. 1). An internal space of the pump case 30B defines and functions as a portion of the cooling water passage 26.

When the drive shaft 14 rotates in response to the driving of the engine 13, the impeller 30A rotates. In other words, the pump 30 is driven in conjunction with the engine 13. Water outside the outboard motor 1 is taken from the inflow port 26A into the cooling water passage 26 as indicated by an arrow Y1 by the rotation of the impeller 30A, and flows through the cooling water passage 26 to the outflow port 26B as cooling water. Cooling water flows through the cooling water passage 26 from the engine 13 into the halfway portion 26C, and hence cools the engine 13. The cooling water that has flowed to the outflow port 36B is discharged from the outflow port 26B to the outside of the outboard motor 1 as indicated by an arrow Y2.

A portion of the cooling water flowing through the cooling water passage 26 flows into the inlet water passage 27 in the connection portion 26D of the cooling water passage 26, and is taken from the inlet 35 of each oil cooler 28 into the water-storing space 34 of the oil cooler 28. The cooling water that has been taken into the water-storing space 34 cools the wall 21A of the engine block 21 that defines a portion of the water-storing space 34. Consequently, the lubrication oil J in the engine block 21 is cooled when the wall 21A is bathed in the lubrication oil J. The cooling water in the water-storing space 34 is discharged from the outlet 36, and flows out to the outlet water passage 29, and then returns to the cooling water passage 26, and is discharged from the outflow port 26B to the outside of the outboard motor 1.

The first thermostat 31 is located at a portion closer to the halfway portion 26C than the connection portion 26E joined to the outlet water passage 29 in the cooling water passage 26. The first thermostat 31 is opened and closed in accordance with the temperature of cooling water flowing through the halfway portion 26C of the cooling water passage 26, and its opening degree changes to an arbitrary value ranging from 0% to 100%. Consequently, the first thermostat 31 increases and decreases the flow rate of cooling water flowing from the engine 13 into the halfway portion 26C. The first thermostat 31 is in a fully closed state when the opening degree is 0%. In this state, the halfway portion 26C is shut off, and therefore the flow rate of cooling water flowing from the engine 13 into the halfway portion 26C becomes zero. The first thermostat 31 is in a fully open state when the opening degree is 100%, and, in this state, the flow rate of cooling water flowing from the engine 13 into the halfway portion 26C becomes the maximum.

The second thermostat 32 includes a second thermostat 32A located at the outlet water passage 29A and a second thermostat 32B located at the outlet water passage 29B. The second thermostat 32A is opened and closed in accordance with the temperature of cooling water flowing through the outlet water passage 29A, and its opening degree changes to an arbitrary value ranging from 0% to 100%. Consequently, the second thermostat 32A increases and decreases the flow rate of cooling water that flows out from the water-storing space 34 of the oil cooler 28A and then flows through the outlet water passage 29A. The second thermostat 32B is opened and closed in accordance with the temperature of cooling water flowing through the outlet water passage 29B, and its opening degree changes to an arbitrary value ranging from 0% to 100%. Consequently, the second thermostat 32B increases and decreases the flow rate of cooling water that flows out from the water-storing space 34 of the oil cooler 28B and then flows through the outlet water passage 29B. The second thermostats 32A and 32B are each in a fully closed state when the opening degree is 0%. In this state, the outlet water passages 29A and 29B are shut off, and therefore the flow rates of cooling water flowing through the outlet water passages 29A and 29B each become zero. The second thermostats 32A and 32B are each in a fully open state when the opening degree is 100%, and, in this state, the flow rates of cooling water flowing through the outlet water passages 29A and 29B each become the maximum.

As described above, according to a preferred embodiment of the present invention, the pump 30 driven in conjunction with the engine 13 takes outside water into the cooling water passage 26 from the inflow port 26A that is located in the water. Outside water that has been taken into the cooling water passage 26 flows through the engine 13 and cools the engine 13 as cooling water, and then flows out from the outflow port 26B. The first thermostat 31 located at the cooling water passage 26 is opened and closed so as to increase and decrease the flow rate of cooling water flowing from the engine 13 into the cooling water passage 26. The flow rate of cooling water flowing from the engine 13 increases due to the first thermostat 31 increasing the opening degree, and therefore it is possible to prevent the engine 13 from being overheated. The flow rate thereof decreases due to the first thermostat 31 decreasing the opening degree, and therefore it is possible to prevent the engine 13 from being cooled excessively.

The inlet water passage 27 that branches from the cooling water passage 26 is connected to the inlet 35 of the oil cooler 28. Cooling water that has flowed into the inlet water passage 27 from the cooling water passage 26 is taken from the inlet 35 into the water-storing space 34 of the oil cooler 28, and cools the lubrication oil J of the engine 13 in the water-storing space 34, and then flows out from the outlet 36 of the oil cooler 28 to the outlet water passage 29. The second thermostat 32 located at the outlet water passage 29 is opened and closed so as to increase and decrease the flow rate of cooling water in the outlet water passage 29.

More specifically, when outside water has a low temperature or when the number of revolutions of the engine 13 is low because of, for example, start-up time, i.e., when the lubrication oil J has a low temperature, the second thermostat 32 decreases its opening degree in accordance with the temperature of the low-temperature cooling water flowing out from the water-storing space 34. Consequently, the second thermostat 32 decreases the flow rate of cooling water in the outlet water passage 29. Therefore, the amount of cooling water taken into the water-storing space 34 decreases, and therefore it is possible to prevent a decrease in the oil temperature. In this state, the lubrication oil J is easily warmed by the engine 13, and therefore it is possible to swiftly increase the oil temperature to the optimum temperature. When the second thermostat 32 decreases its opening degree, the first thermostat 31 also decreases its opening degree, and therefore the engine 13 is also prevented from being lowered in temperature. Preferably, at this time, the flow rate of water flowing through the outlet water passage 29 (i.e., the opening degree of the second thermostat 32) is zero, and yet it may be larger than zero if it is slight. The same applies to the flow rate of cooling water flowing through the engine 13.

On the other hand, when the engine 13 rotates at high speed, i.e., when the lubrication oil J has a high temperature, the second thermostat 32 increases its opening degree in accordance with the temperature of cooling water that has become high in temperature due to heat exchange with the lubrication oil J. Consequently, the second thermostat 32 increases the flow rate of cooling water in the outlet water passage 29. Therefore, the lubrication oil J is effectively cooled by a large amount of cooling water newly taken into the water-storing space 34, and therefore it is possible to prevent the oil temperature from exceeding the optimum temperature. At this time, the first thermostat 31 increases its opening degree so as to increase the flow rate of cooling water flowing through the engine 13, and therefore the engine 13 is also prevented from becoming high in temperature.

Based on the above result, it is possible to keep the oil temperature at the optimum temperature regardless of the surrounding environment or the number of revolutions of the engine 13. The supplied amount of cooling water to the oil cooler 28 is variable when the oil temperature is low and when the oil temperature is high as described above, and therefore it is possible to keep the oil temperature at the optimum temperature even if the amount of heat generated by the engine 13 or the cooling area of the oil cooler 28 is not varied.

Figure 5:
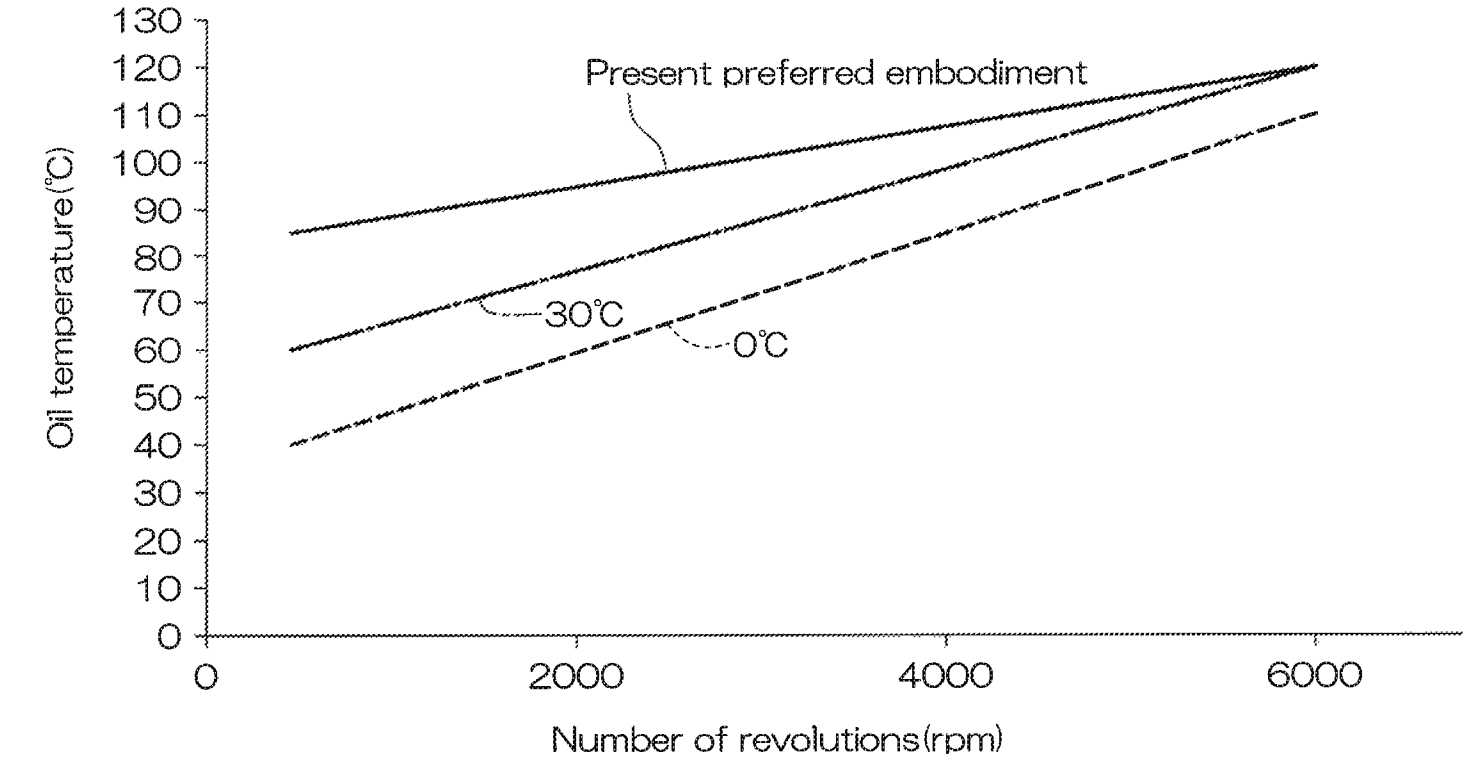
FIG. 5 is a graph showing a relationship between the number of revolutions of an engine and an oil temperature.

FIG. 5 is a graph showing a relationship between the number of revolutions of the engine 13 and an oil temperature. In the graph of FIG. 5, the abscissa axis indicates the number of revolutions of the engine 13 (unit: rpm), and the ordinate axis indicates an oil temperature (unit: ° C.). In a comparative example in which the cooling device 25 of the present preferred embodiment is not provided, in a low-temperature environment in which the temperature of the outside water is about 0° C., the oil temperature is about 40° C. when the engine 13 rotates at low speed, whereas the oil temperature is about 110° C. when the engine 13 rotates at high speed (see the broken line). In this comparative example, in a high-temperature environment in which the temperature of the outside water is about 30° C., the oil temperature is about 60° C. when the engine 13 rotates at low speed, whereas the oil temperature is about 120° C., for example, when the engine 13 rotates at high speed (see the alternate long and short dashed line). On the other hand, in the present preferred embodiment in which the cooling device 25 is provided, regardless of the temperature of outside water, the oil temperature is about 80° C. when the engine 13 rotates at low speed, whereas the oil temperature is about 120° C., for example, when the engine 13 rotates at high speed (see the solid line). In short, in the present preferred embodiment, it is possible to keep the highest oil temperature during high-speed engine revolutions at the same level as in the comparative example, and it is possible to make the lowest oil temperature during low-speed engine revolutions higher than in the comparative example. Additionally, in the present preferred embodiment, it is possible to keep the oil temperature at the optimum temperature within a predetermined range (herein, about 70° C. to about 120° C., for example) regardless of the temperature of the outside water and regardless of the number of revolutions of the engine 13.

Additionally, the second thermostat 32 is located at the outlet water passage 29, and therefore it is possible to perform an opening-closing operation based on the temperature of cooling water immediately after heat exchange with the lubrication oil J in the oil cooler 28. Consequently, when the engine 13 rotates at high speed, the second thermostat 32 increases its opening degree so that the temperature of cooling water whose temperature has become higher due to heat exchange with the lubrication oil J in the oil cooler 28 becomes lower, and increases the flow rate of cooling water flowing through the outlet water passage 29. On the other hand, for example, when outside water has a low temperature, the second thermostat 32 decreases its opening degree so that the temperature of cooling water whose temperature is still low after heat exchange with the lubrication oil J in the oil cooler 28 becomes higher, and decreases the flow rate of cooling water flowing through the outlet water passage 29. The second thermostat 32 may be located at the outlet 36 of the oil cooler 28, and, in this case, it is possible to achieve the same operations and effects as in a case in which the second thermostat 32 is located at the outlet water passage 29. It is also possible to locate the second thermostat 32 at the inlet 35 of the oil cooler 28.

According to a preferred embodiment of the present invention, the outlet water passage 29 joins the cooling water passage 26. With this structure, cooling water that has flowed out from the outlet 36 of the oil cooler 28 to the outlet water passage 29 is returned to the cooling water passage 26, and is discharged outwardly from the outflow port 26B. Therefore, another other outflow port, different from the outflow port 26B, is not required to be provided as a discharge port to outwardly discharge cooling water flowing through the outlet water passage 29. It is possible to keep the oil temperature at an optimum temperature with this simple structure. If a simple structure is not necessary, another outflow port may be provided independently of the outflow port 26B so that cooling water in the outlet water passage 29 and cooling water in the cooling water passage 26 are discharged individually.

According to a preferred embodiment of the present invention, the engine 13 includes the engine block 21 in which the lubrication oil J is contained, and the oil cooler 28 is located at the wall 21A that is bathed in the lubrication oil J in the engine block 21. With this structure, the lubrication oil J in which the wall 21A in the engine block 21 has been bathed is cooled by allowing cooling water taken into the water-storing space 34 of the oil cooler 28 to cool the wall 21A. Therefore, a structure in which the lubrication oil J in the engine block 21 is taken out, and is cooled by the oil cooler 28, and is then returned into the engine block 21 is not required. It is possible to keep the oil temperature at the optimum temperature with this simple structure. If a simple structure is not necessary, it is permissible to dispose the oil cooler 28 separately from the engine block 21, and take out the lubrication oil J in the engine block 21, and cool the lubrication oil J with the oil cooler 28, and then return the lubrication oil J into the engine block 21.

According to a preferred embodiment of the present invention, the oil cooler 28 includes the wall 21A and the cover 33 that is attached to the wall 21A and that defines the water-storing space 34. With this structure, it is possible to define the water-storing space 34 by attaching the cover 33 to the wall 21A. It is possible to keep the oil temperature at the optimum temperature with this simple structure.

According to a preferred embodiment of the present invention, the outlet 36 is provided in the cover 33. With this structure, it is possible to allow cooling water in the water-storing space 34 to flow out from the outlet 36 to the outlet water passage 29 by connecting the outlet water passage 29 to the outlet 36 of the cover 33.

According to a preferred embodiment of the present invention, the outboard motor 1 includes a plurality of oil coolers 28. With this structure, the cooling effect of the lubrication oil J is increased by the plurality of oil coolers 28, and therefore it is possible to prevent the oil temperature from exceeding the optimum temperature. Likewise, with this structure, it is possible to swiftly increase the oil temperature to the optimum temperature while preventing a decrease in the oil temperature by the second thermostat 32, for example, when the outside water has a low temperature or when the number of revolutions of the engine 13 is low, and therefore it is possible to keep the oil temperature at the optimum temperature.

Although preferred embodiments of the present invention have been described above, the present invention is not restricted to the contents of these preferred embodiments and various modifications are possible within the scope of the present invention.

Figure 6:
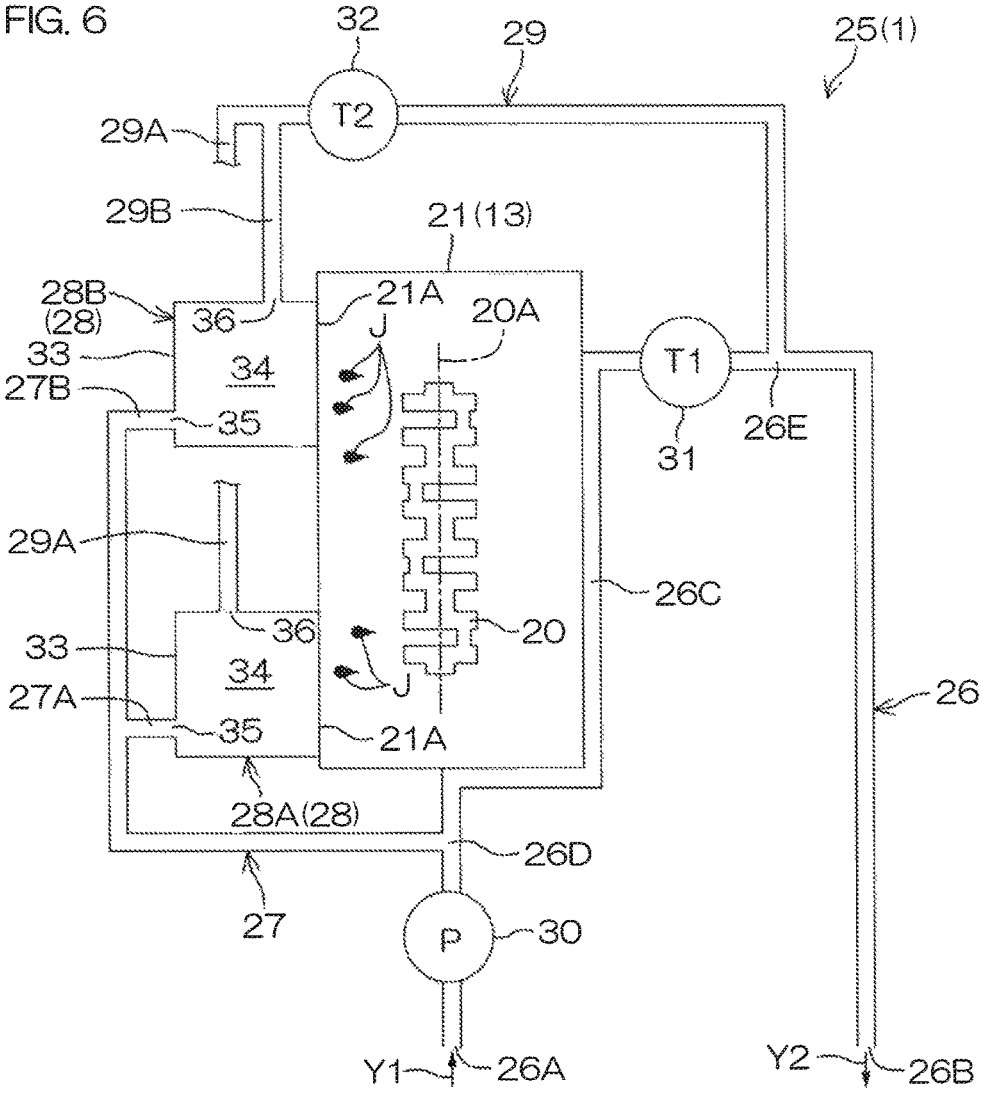
FIG. 6 is a schematic view showing a cooling device according to a modified preferred embodiment of the present invention.

The second thermostat 32 may be located at a junction portion between the outlet water passage 29A and the outlet water passage 29B as shown in FIG. 6 and not located at both the outlet water passage 29A and the outlet water passage 29B into which the outlet water passage 29 branches, as in the above-described preferred embodiments.

A heat exchanger (not shown) different from the oil cooler 28 may be spaced apart from the engine 13 or from the oil cooler 28 so that the lubrication oil J is cooled by the heat exchanger and the oil cooler 28.

An electric component may be attached to the cover 33 of the oil cooler 28. With this structure, it is possible to cool the electric component placed on the cover 33 by cooling water in the water-storing space 34 of the oil cooler 28.

The pump 30 continuously takes cooling water into the cooling water passage 26 during the operation of the engine 13 even in a state in which the opening degree of the first thermostat 31 or of the second thermostat 32 is small, and therefore it is assumed that water pressure in the cooling water passage 26 will increase. Therefore, a relief valve (not shown), such as a pressure control valve, may be provided in the cooling water passage 26. In this case, a by-pass flow passage (not shown) that connects the relief valve to a portion closer to the outflow port 26B than the connection portion 26E in the cooling water passage 26 may be provided, for example. The relief valve is opened in accordance with an increase in the water pressure in the inside of the cooling water passage 26 to a predetermined value, and therefore water upstream of the relief valve in the cooling water passage 26 escapes to the outflow port 26B through the by-pass flow passage, and is forcibly discharged outwardly from the outboard motor 1.

Also, features of two or more of the various preferred embodiments described above may be combined.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:

an engine;

a cooling water passage through which water flows from an inflow port, located in outside water outside the outboard motor, to an outflow port, via the engine;

a pump that takes the outside water from the inflow port into the cooling water passage by being driven in conjunction with the engine;

an inlet water passage that branches from the cooling water passage;

an oil cooler that cools lubrication oil in the engine, the oil cooler including an inlet connected to the inlet water passage, a water-storing space into which water in the inlet water passage is taken from the inlet, and an outlet from which water in the water-storing space is discharged;

an outlet water passage connected to the outlet;

a first thermostat located in the cooling water passage and that increases and decreases a flow rate of water flowing through the engine; and a second thermostat located at the outlet or at the outlet water passage and that increases and decreases a flow rate of water flowing through the outlet water passage.

2. The outboard motor according to claim 1, wherein the outlet water passage is joined to the cooling water passage.

3. The outboard motor according to claim 1, wherein the engine includes an engine block in which the lubrication oil is contained; and the oil cooler is located at a wall that is bathed in the lubrication oil in the engine block.

4. The outboard motor according to claim 3, wherein the oil cooler includes the wall and a cover attached to the wall and that defines the water-storing space.

5. The outboard motor according to claim 4, wherein the outlet is located in the cover.

6. The outboard motor according to claim 1, wherein the oil cooler includes a plurality of oil coolers.

* * * * *